US006589369B2

(12) United States Patent
Yokoi et al.

(10) Patent No.: US 6,589,369 B2
(45) Date of Patent: Jul. 8, 2003

(54) HIGH FATIGUE STRENGTH STEEL SHEET EXCELLENT IN BURRING WORKABILITY AND METHOD FOR PRODUCING THE SAME

(75) Inventors: Tatsuo Yokoi, Futtsu (JP); Manabu Takahashi, Futtsu (JP); Hiroyuki Okada, Tokai (JP); Toshimitsu Aso, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/890,048

(22) PCT Filed: Dec. 15, 2000

(86) PCT No.: PCT/JP00/08934

§ 371 (c)(1),
(2), (4) Date: Jul. 25, 2001

(87) PCT Pub. No.: WO01/81640

PCT Pub. Date: Nov. 1, 2001

(65) Prior Publication Data

US 2002/0179193 A1 Dec. 5, 2002

(30) Foreign Application Priority Data

Apr. 21, 2000 (JP) ..... 2000-121209
Apr. 21, 2000 (JP) ..... 2000-121210

(51) Int. Cl.[7] ..... C22C 38/06; C22C 38/02; C22C 38/16; C21D 8/00

(52) U.S. Cl. ..... 148/320; 148/330; 148/332; 148/331; 148/333; 148/334; 148/335; 148/602; 148/336; 148/603; 148/652

(58) Field of Search ..... 148/320, 330, 148/331, 332–336, 602, 603, 661, 652, 604

(56) References Cited

U.S. PATENT DOCUMENTS 5,505,796 A * 4/1996 Kawano et al. ..... 148/546

FOREIGN PATENT DOCUMENTS

JP H5-179396 7/1993

(List continued on next page.)

OTHER PUBLICATIONS

R.C. Ruhl, M. Cohen, *Transactions of the Metallurgical Society of AIME*, vol. 245 (1996), p. 241.
Hiroyoshi Soejima, *Electron Beam Micro Analysis*, published from Nikkan Kogyo Shimbunsha, Oct. 10, 2000.
A.T. Davenport, *Formable HSLA and Dual–Phase Steels* (1977), Fig. 4 on p. 131.

*Primary Examiner*—Deborah Yee
(74) *Attorney, Agent, or Firm*—Kenyon & Kenyon

(57) ABSTRACT

A compound structure steel sheet excellent in burring workability made of a steel containing, by mass, 0.01 to 0.3% of C, 0.01 to 2% of Si, 0.05 to 3% of Mn, 0.1% or less of P, 0.01% or less of S, and 0.005 to 1% or Al, and having the microstructure being a compound structure having ferrite as the main phase and martensite or retained austenite mainly as the second phase, the quotient of the volume percentage of the second phase divided by the average grain size of the second phase being 3 or more and 12 or less, and the quotient of the average hardness of the second phase divided by the average hardness of the ferrite being 1.5 or more and 7 or less; or a compound structure steel sheet excellent in burring workability made of a steel containing, by mass, 0.01 to 0.3% of C, 0.01 to 2% of Si, 0.05 to 3% of Mn, 0.1% or less of P, 0.01% or less of S, and 0.005 to 1% or Al, having the microstructure being a compound structure having ferrite as the main phase and martensite or retained austenite mainly as the second phase, the average grain size of the ferrite being 2 μm or more and 20 μm or less, the quotient of the average grain size of the second phase divided by the average grain size of the ferrite being 0.05 or more and 0.8 or less, and the carbon concentration in the second phase being 0.2% or more and 3% or less.

21 Claims, 3 Drawing Sheets

U.S. PATENT DOCUMENTS

| | | |
|---|---|---|
| JP | 8-3679 | 1/1996 |
| JP | 8-325671 | 12/1996 |
| JP | 11-199973 | 7/1999 |
| JP | 11-199975 | 7/1999 |
| JP | 11-279694 | 10/1999 |
| JP | H5-163590 | 6/2001 |

* cited by examiner

HIGH FATIGUE STRENGTH STEEL SHEET EXCELLENT IN BURRING WORKABILITY AND METHOD FOR PRODUCING THE SAME

TECHNICAL FIELD

This invention relates to a compound structure steel sheet excellent in burring workability, having a tensile strength of 540 MPa or more, and a method to produce the same, and, more specifically, to a high fatigue strength steel sheet excellent in hole expansibility (burring workability) and suitable as a material for roadwheels and other undercarriage parts of cars wherein both the hole expansibility and durability are required, and a method to produce the same.

BACKGROUND ART

The application of light metals such as aluminum alloys and high strength steel sheets to car components is being increased to achieve fuel economy and other related advantages through car weight reduction. Although light metals such as aluminum alloys have an advantage of high specific strength, their application is limited to special uses because of a far higher cost than steel. To further reduce car weight, therefore, a wider application of low cost, high strength steel sheets is required.

Facing the demands for higher strength, against the above background, various new steel sheets having high strength, deep drawability, bake-hardenability, etc. have so far been developed in the field of cold-rolled steel sheets used for bodies and panels, which account for a quarter or so of the total car weight, and these developments have contributed to the reduction in car weight. The focus of efforts for car weight reduction, however, has lately shifted to structural members and undercarriage components, which account for about 20% of the total car weight. In this situation, immediate action is demanded in the development of high strength hot-rolled steel sheets for these applications.

However, generally speaking, high strength is obtained at a cost of other material properties such as formability (workability) and, therefore, the key issue in the development of the high strength steel sheets is how to raise steel strength without sacrificing other material properties. Hole expansibility, fatigue resistance, corrosion resistance and the like are important among the properties required of steel sheets used especially for structural members and undercarriage components. It is essential, in this development, to realize high strength together with high values of these properties in a well-balanced manner.

Among the properties required of the steel sheets for roadwheel discs, for example, hole expansibility and fatigue resistance are regarded as particularly important. This is because burring (hole expansion) to form a hub hole is especially difficult, among various working stages, in forming a roadwheel disc and the fatigue resistance is the aspect controlled under the most stringent standards among the properties required of wheel components.

In consideration of the fatigue resistance of the wheel components, high strength hot-rolled steel sheets of 590 MPa class ferrite-martensite compound structure steel (the so-called dual-phase steel) excellent in fatigue property are presently used for the roadwheel discs. The level of strength required of the steel sheets for these components, however, is rising yet further from the 590 MPa class to the 780 MPa class. In addition to the fact that the hole expansibility tends to lower as the steel strength increases, the compound structure steel sheets are believed to be handicapped with regard to the hole expansibility because of their inhomogeneous structure. For this reason, the hole expansibility, which does not constitute any problem in the 590 MPa class compound structure steel sheets, may become a problem with 780 MPa class compound structure steel sheets.

This means that the hole expansibility is highlighted, in addition to the fatigue resistance, as an important subject in the application of high strength steel sheets to roadwheels and other undercarriage components of cars. However, despite the strong demands, few inventions have been proposed, save for a limited number of exceptions, to provide high strength steel sheets having a microstructure of a ferrite-martensite compound structure to improve the fatigue resistance, and which are also excellent in hole expansibility.

Japanese Unexamined Patent Publication No. H5-179396, for example, discloses a technology to secure the fatigue resistance of a steel sheet by forming its microstructure to consist of ferrite and martensite or retained austenite, and to ensure the hole expansibility by strengthening ferrite with precipitates of TiC, NbC, etc. so that the strength difference between ferrite grains and a martensite phase may be decreased and deformation may not concentrate locally on ferrite grains.

In the steel sheets for some of the undercarriage components such as roadwheel discs, it is essential to realize a well-balanced and high-level combination of formability such as burring workability and fatigue resistance, but the above technology does not offer these properties in a satisfactory manner. Besides, even if both the formability and fatigue resistance are satisfactory, it is important to provide a production method capable of providing these features economically and stably and, in this respect, the above conventional technology is insufficient.

To be more specific, the technology disclosed in Japanese Unexamined Patent Publication No. H5-179396 is incapable of providing a sufficient elongation because it proposes to strengthen the ferrite grains by precipitation hardening. Nor is it capable of providing a low yield ratio, which is a unique characteristic of the ferrite-martensite compound structure, because the precipitates block movable, high-density dislocations created around the martensite phase during production. Besides, the addition of Ti and Nb is not desirable since it raises production costs.

In view of the above, the object of the present invention is to provide a compound structure steel sheet capable of advantageously solving the above problems of conventional technologies, excellent in fatigue resistance and burring workability (hole expansibility) and having a tensile strength of 540 MPa or more, and a method to produce said steel sheet economically and stably.

DISCLOSURE OF THE INVENTION

Keeping in mind the production processes of hot-rolled and cold-rolled steel sheets presently produced on an industrial scale using generally employed steel sheet production facilities, the present inventors earnestly studied the means to achieve both good burring workability and high fatigue resistance of steel sheets. As a result, the present invention was established based on the new discovery that achieving the following was very effective for enhancing the burring workability: that microstructure is a compound structure having ferrite as the main phase and martensite or retained austenite mainly as the second phase; that the average grain size of the ferrite is 2 μm or more and 20 μm or less, that the quotient of the average grain size of the second phase divided by the average grain size of the ferrite is 0.05 or more and 0.8 or less, and that the carbon concentration of the second phase is 0.2% or more and 2% or less; that the quotient of the volume percentage of the second phase divided by the average grain size of the second phase is 3 or more and 12 or less; and that the quotient of the average hardness of the second phase divided by the average hardness of the ferrite is 1.5 or more and 7 or less.

The gist of the present invention, therefore, is as follows:

(1) A high fatigue strength steel sheet excellent in burring workability characterized in that:

the steel sheet is made of a steel containing, in mass, 0.01 to 0.3% of C, 0.01 to 2% of Si, 0.05 to 3% of Mn, 0.1% or less of P, 0.01% or less of S, and 0.005 to 1% or Al, and the balance consisting of Fe and unavoidable impurities; the microstructure is a compound structure having ferrite as the main phase and martensite as the second phase; the average grain size of the ferrite is 2 μm or more and 20 μm or less;

the quotient of the average grain size of the second phase divided by the average grain size of the ferrite is 0.05 or more and 0.8 or less; and the carbon concentration in the second phase is 0.2% or more and 3% or less.

(2) A high fatigue strength steel sheet excellent in burring workability characterized in that:

the steel sheet is made of a steel containing, in mass, 0.01 to 0.3% of C, 0.01 to 2% of Si, 0.05 to 3% of Mn, 0.1% or less of P, 0.01% or less of S, and 0.005 to 1% or Al, and the balance consisting of Fe and unavoidable impurities;

the microstructure is a compound structure having ferrite as the main phase and martensite as the second phase; the quotient of the volume percentage of the second phase divided by its average grain size is 3 or more and 12 or less; and the quotient of the average hardness of the second phase divided by the average hardness of the ferrite is 1.5 or more and 7 or less.

(3) A high fatigue strength steel sheet excellent in burring workability characterized in that; the steel according to the item (1) or (2) further contains, in mass, 0.2 to 2% of Cu, and the Cu exists in the ferrite phase of the steel in the state of the precipitates of grains 2 nm or less in size consisting purely of Cu and/or in the state of solid solution.

(4) A high fatigue strength steel sheet excellent in burring workability characterized in that the steel according to any one of the items (1) to (3) further contains, in mass, 0.0002 to 0.002% of B.

(5) A high fatigue strength steel sheet excellent in burring workability characterized in that the steel according to any one of the items (1) to (4) further contains, in mass, 0.1 to 1% of Ni.

(6) A high fatigue strength steel sheet excellent in burring workability characterized in that the steel according to any one of the items (1) to (5) further contains, in mass, one or both of 0.0005 to 0.002% of Ca and 0.0005 to 0.02% of REM.

(7) A high fatigue strength steel sheet excellent in burring workability characterized in that the steel according to any one of the items (1) to (6) further contains, in mass, one or more of;

0.05 to 0.5% of Ti, 0.01 to 0.5% of Nb, 0.05 to 1% of Mo, 0.02 to 0.2% of V, 0.01 to 1% of Cr, and 0.02 to 0.2% of Zr.

(8) A high fatigue strength steel sheet excellent in burring workability characterized in that; the steel sheet is made of a steel having the chemical composition according to any one of the items (1) to (7), and the microstructure is a compound structure having ferrite as the main phase and retained austenite accounting for a volume percentage of 5% or more and 25% or less as the second phase.

(9) A method to produce a high fatigue strength steel sheet excellent in burring workability characterized by, when hot rolling a slab having the chemical composition according to any one of the items (1) to (7), completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of 350° C. or lower.

(10) A method to produce a high fatigue strength steel sheet excellent in burring workability characterized by, when hot rolling a slab having the chemical composition according to any one of the items (1) to (7), applying high pressure descaling to the slab after rough rolling, completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of 350° C. or lower.

(11) A method to produce a high fatigue strength steel sheet excellent in burring workability characterized by completing the hot rolling of a slab having the chemical composition according to any one of the items (1) to (7) at a temperature of the $Ar_3$ transformation temperature or higher, subsequently pickling and cold-rolling the hot-rolled steel sheet thus produced, holding the cold-rolled steel sheet in the temperature range from the $Ac_1$ transformation temperature to the $Ac_3$ transformation temperature for 30 to 150 sec., and then cooling it at a cooling rate of 20° C./sec. or higher to the temperature range of 350° C. or lower.

(12) A method to produce a high fatigue strength steel sheet excellent in burring workability characterized by, when hot rolling a slab having the chemical composition according to any one of the items (1) to (7), completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of above 350° C. and 450° C. or lower.

(13) A method to produce a high fatigue strength steel sheet excellent in burring workability characterized by, when hot rolling a slab having the chemical composition according to any one of the items (1) to (7), applying high pressure descaling to the slab after rough rolling, completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of above 350° C. and 450° C. or lower.

(14) A method to produce a high fatigue strength steel sheet excellent in burring workability characterized by, completing the hot rolling of a slab having the chemical composition according to any one of the items (1) to (7) at a temperature of the $Ar_3$ transformation temperature or higher, subsequently pickling and cold rolling the hot-rolled steel sheet thus produced, holding the cold-rolled steel sheet in the temperature range from the $Ac_1$ transformation temperature to the $Ac_3$ transformation temperature for 30 to 150 sec., then cooling it at a cooling rate of 20° C./sec. or higher, holding it in the temperature range of above 350° C. and 450° C. or lower for 15 to 600 sec., and cooling it at a cooling rate of 5° C./sec. or higher to the temperature range of 150° C. or below.

BEST MODE FOR CARRYING OUT THE INVENTION

The results of the fundamental researches which led to the present invention will be described.

The influence of the average grain size of the ferrite and the size of the second phase on hole expansibility was investigated first. The specimens for the test were prepared in the following manner: completing the finish hot rolling of steel slabs having the chemical compositions of 0.07% C-1.6% Si-2.0% Mn-0.01% P-0.001% S-0.03% Al at different temperatures of the $Ar_3$ transformation temperature or above, holding the hot-rolled sheets thus produced in different temperature ranges from the $Ar_1$ transformation temperature to the $Ar_3$ transformation temperature for 1 to 15 sec., cooling at a cooling rate of 20° C./sec. or higher, and then coiling at an ordinary temperature.

Figure 1:
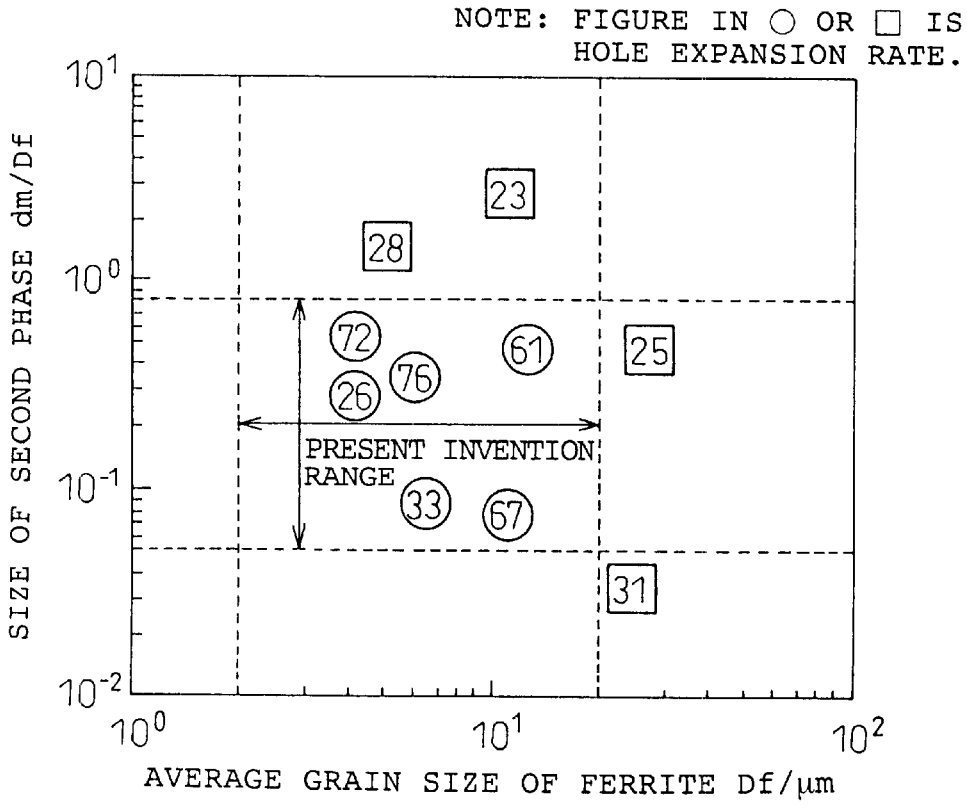
FIG. 1 is a graph showing the relationship between an average ferrite grain size, the size of second phase and a hole expansion rate obtained from the result of a preliminary test for the present invention.

FIG. 1 shows the result of the hole expanding test of the steel sheets thus prepared in relation to the average grain size of the ferrite and the size of the second phase.

From the result, the present inventors newly discovered that there was a strong correlation between hole expansibility and each of the average grain size of the ferrite and the size of the second phase (the quotient of the average grain size of the second phase divided by the average grain size of the ferrite), and that the hole expansibility was markedly enhanced when the average grain size of the ferrite was 2 $\mu$m or more and 20 $\mu$m or less and the quotient of the average grain size of the second phase divided by the average grain size of the ferrite is 0.05 or more and 0.8 or less.

The mechanism for this is not altogether clear, but it is supposed to be as follows: if the size of the second phase is too large, voids form easily at the interface between the second phase and its parent phase and the voids serve as initial points of cracks during hole expansion; if it is too small, local ductility, which correlates with the hole expansion rate, is lowered; and thus the hole expansion rate increases when the second phase has the optimum size and interval. It is also supposed that, if the average grain size of the ferrite is too small, yield stress increases adversely affecting the shape-freezing property after forming, and if it is too large, the microstructure becomes inhomogeneous and local ductility, which correlates with the hole expansion rate, is lowered.

Note that the average grain size of ferrite was measured in accordance with the section method stipulated in the test method of ferrite crystal grain size of JIS G 0552 steel, and that the average grain size of the second phase was defined as the equivalent diameter of an average circle and the value obtained from an image processor and the like was used.

Figure 2:
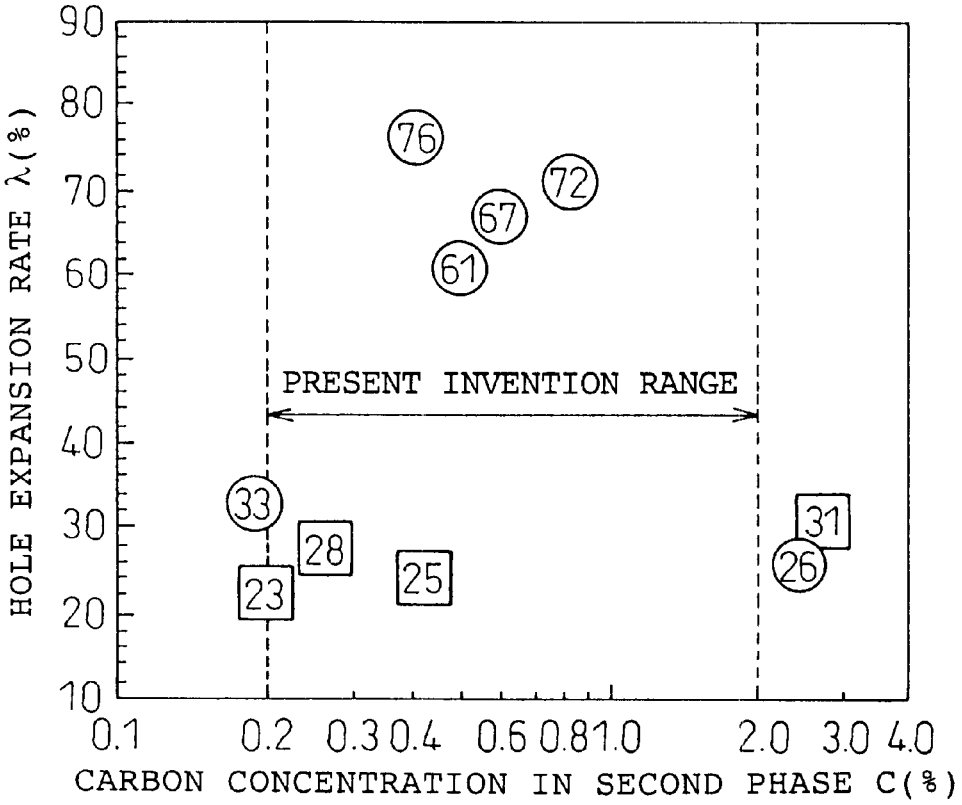
FIG. 2 is a graph showing the relationship between carbon concentration in the second phase and a hole expansion rate obtained from the result of a preliminary test for the present invention.

Then, the influence of the carbon concentration in the second phase on the hole expansibility was investigated. FIG. 2 shows the hole expansibility of the above steel sheets in relation to the carbon concentration in the second phase. The present inventors newly discovered from the result that there was a strong correlation between the carbon concentration in the second phase and the hole expansibility and that, when the carbon concentration in the second phase was 0.2% or more and 2% or less, the hole expansibility was markedly improved.

The mechanism for this is not altogether clear either, but it is supposed to be as follows: if the carbon concentration in the second phase is too high, the strength difference between the second phase and its parent phase becomes large and, as a result, voids form easily at the interface between them during punching work and the voids serve as initial points of cracks during hole expansion; if the carbon concentration in the second phase is too low, on the other hand, the ductility of the ferrite phase inevitably lowers and local ductility, which correlates with the hole expansion rate, lowers and the hole expansion rate decreases; and thus the hole expansion rate increases when the carbon concentration in the second phase assumes an optimum value.

If the carbon concentration in the second phase exceeds 1.2%, however, heat affected zones soften remarkably during welding by spot welding or similar methods and the softened heat affected zones may trigger fatigue failures. For this reason, it is preferable that the carbon concentration in the second phase falls within the range from 0.2 to 1.2%.

Note that the hole expansibility (burring workability) was evaluated following the hole expanding test method according to the Japan Iron and Steel Federation Standard JFS T 1001-1996.

Next, the microstructure and the carbon concentration in the second phase of a steel sheet according to the present invention will be explained in detail.

To obtain good values in both the fatigue property and the burring workability (hole expansibility), the microstructure of a steel sheet according to the present invention is defined to be a compound structure having ferrite as the main phase and martensite or retained austenite mainly as the second phase. Note that the second phase may contain unavoidable bainite and pearlite.

Here, the volume percentages of the retained austenite, ferrite, bainite, pearlite and martensite are defined as the respective area percentages observed by a optical microscope at a magnification of 200 to 500 times in the microstructure on the section surface at ¼ of the sheet thickness of the specimens cut out from the ¼ or ¾ width position of the steel sheets, after polishing the section surface along the rolling direction and etching it with a nitral reagent and a reagent disclosed in Japanese Unexamined Patent Publication No. H5-163590.

Austenite can easily be identified crystallographically because its crystal structure is different from that of ferrite. The volume percentage of the retained austenite can therefore be obtained experimentally by the X-ray diffraction method. This is a simplified method to calculate the volume percentages of austenite and ferrite from the difference between the two in the reflection surface intensity under irradiation by Kα-rays of Mo, using the following equation:

$$V\gamma=(2/3)\{100/(0.7\times\alpha(211)/\gamma(220)+1)\}+(1/3)\{100/(0.78\times\alpha(211)/\gamma(311)+1)\},$$

where, α(211), γ(220) and γ(311) are the X-ray reflection surface intensities of ferrite (α) and austenite (γ), respectively.

Since the optical microscope observation and the X-ray diffraction method yield nearly identical measurements of the volume percentage of the retained austenite, either of the measurements may be used.

The carbon concentration in the retained austenite can be obtained experimentally by either the X-ray diffraction method or by Mössbauer spectrometry. By the X-ray diffraction method, for example, the carbon concentration in the retained austenite can be measured from the relationship between the carbon concentration and the change in lattice constant caused by the placement of C, an interstitial solid solution element, at the crystal lattice of austenite. The lattice constant is obtained by measuring the angles of reflection of (002), (022), (113) and (222) planes of austenite using Kα-rays of Co, Cu and Fe, and calculating it from the angle of reflection described in a literature (B. D. Cullity: Fundamentals of X-ray Diffraction, translated by Gentaro Matsumura, published by Agne). Here, since there is a linear correlation between $COS^2\theta$(θ: angle of reflection) and lattice constant a, true lattice constant $a_0$ is obtained by extrapolating $\cos^2\theta=0$ with the straight line. The carbon concentration in the retained austenite can be obtained also from the value of the true lattice constant $a_0$ using the relationship between the lattice constant of austenite and the carbon concentration in the austenite such as equation $a_0$=3.572+0.033% C (carbon concentration) described in the literature (R. C. Ruhl and M. Cohen: Transaction of the Metallurgical Society of AIME, vol. 245 (1969) p241).

If the second phase is martensite, then the carbon concentration in the second phase is the value obtained by the calibration curve method described in a literature (Hiroyoshi Soejima: Electron Beam Micro Analysis, published from Nikkan Kogyo Shimbunsha) using an electron probe micro analyzer (EPMA). Note that, because five or more of the second phase grains were measured, the carbon concentration value is an average value of the measured grains. The carbon concentration in the retained austenite may be obtained by the following simplified measuring method as a substitution to the above methods, namely a method to calculate it from the carbon content of the entire steel (the phase having the largest volume percentage and the second phase), which is the average carbon concentration in the entire steel, and the carbon concentration in the ferrite.

The carbon content of all the steel (the phase having the largest volume percentage and the second phase) is the carbon content in steel chemical composition, and the carbon concentration in the ferrite can be calculated from a bake-hardenability index (hereinafter BH). Note that the amount of BH (MPa) here is the value obtained by giving a 2.0% pre-strain to a JIS No. 5 test piece for tensile test, heat-treating it at 170° C. for 20 min. and conducting a tensile test again, which value represents the difference between the flow stress under the 2.0% pre-strain before the heat treatment and the yield point after the heat treatment.

The BH amount of a compound structure steel may be regarded to correlate to the solute carbon amount in ferrite, since it is safe to consider that the hard second phase does not deform plastically under a pre-strain of 2.0% or so.

The relationship between the solute carbon amount and the BH amount of compound structure steels is shown in the literature (A. T. Davenport: Formable HSLA and Dual-Phase Steels (1977), FIG. 4 on p.131). From the relationship given therein, the relationship between the BH amount and the solute carbon amount of compound structure steels can be approximated as follows:

$$Cs(\text{solute carbon amount})=1.5\times10^{-4}\exp(0.033\times BH).$$

The carbon concentration in the second phase can, therefore, be estimated by the following equation:

$$Cm=[C(\text{carbon content of steel})-Cs]/fM(\text{volume percentage of the second phase}).$$

There is a very good correlation between the carbon concentration in the second phase estimated by the above equation and the same obtained using EPMA.

Figure 3:
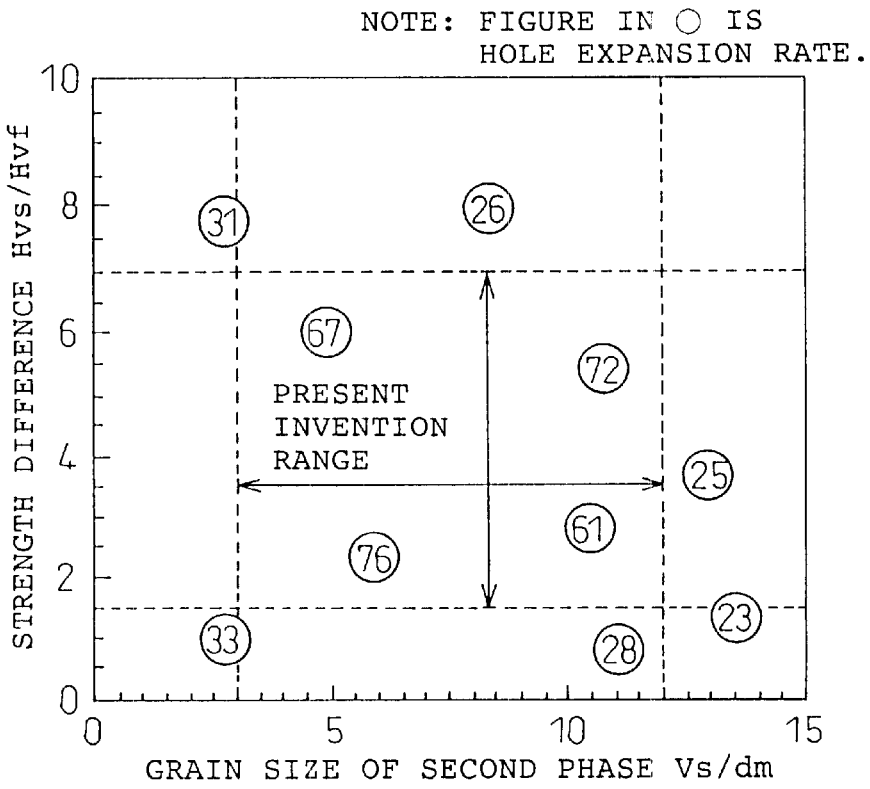
FIG. 3 is a graph showing the relationship between the quotient of the volume percentage of the second phase divided by the average grain size of the second phase, the quotient of the average hardness of the second phase divided by the average hardness of the ferrite and a hole expansion rate obtained from the result of a preliminary test for the present invention.

FIG. 3 shows the result of the hole expanding tests of the steel sheets in terms of the quotient of the volume percentage of the second phase Vs divided by the average grain size of the second phase dm and the quotient of the average hardness of the second phase Hvs divided by the average hardness of the ferrite Hvf.

From this, the present inventors discovered that there was a strong correlation between hole expansibility and each of the quotient of the volume percentage of the second phase divided by the average grain size of the second phase and the quotient of the average hardness of the second phase divided by the average hardness of the ferrite, and that the hole expansibility improved remarkably when the quotient of the volume percentage of the second phase divided by the average grain size of the second phase was 3 or more and 12 or less and the quotient of the average hardness of the second phase divided by the average hardness of ferrite was 1.5 or more and 7 or less.

The mechanism for this is not altogether clear either, but it is supposed to be as follows: if the quotient of the volume percentage of the second phase divided by the average grain size of the second phase (which quotient represents the grain size of the second phase) is too large, then the microstructure becomes inhomogeneous and voids are likely to form at the interface between the second phase and its parent phase, and the voids are likely to initiate cracks during hole expansion; if the above quotient is too small, local ductility, which correlates with the hole expansion rate, is lowered; and thus the hole expansion rate increases when the quotient assumes an optimum value.

It is also supposed that, if the quotient of the average hardness of the second phase divided by the average hardness of the ferrite (which quotient represents the hardness difference between the ferrite and the second phase) is too large, voids are likely to form at the interface between the second phase and its parent phase and the voids are likely to initiate cracks during hole expanding, and that, if the above quotient is too small, the effect of the second phase to arrest fatigue cracks is lost and, thus, it becomes difficult to obtain a good hole expansibility and a good fatigue property at the same time.

The reasons for the definition of the chemical composition of a steel sheet according to the present invention will be explained. The content of each of the elements is defined in mass.

C is indispensable for obtaining a desired microstructure. When its content exceeds 0.3%, however, it deteriorates workability and weldability and, hence, its content has to be 0.3% or less. When the C content is below 0.01%, steel strength decreases and, therefore, its content has to be 0.01% or more.

Si is indispensable for obtaining a desired microstructure, and is effective for enhancing strength through solid solution hardening. Its content has to be 0.01% or more for obtaining a desired strength but, when contained in excess of 2%, it deteriorates workability. The Si content, therefore, has to be 0.01% or more and 2% or less.

Mn is effective for enhancing strength through solid solution hardening. Its content has to be 0.05% or more for obtaining a desired strength but, when added in excess of 3%, cracks occur in slabs. Thus its content has to be 3% or less.

P is an undesirable impurity and the lower its content, the better. When its content exceeds 0.1%, workability and weldability are adversely affected, and so is fatigue property. Therefore, its content has to be 0.1% or less.

S is an undesirable impurity and the lower its content, the better. When its content is too large, the A type inclusions detrimental to the hole expansibility are formed and, for this reason, its content has to be minimized. An S content of 0.01% or less is permissible.

0.005% or more of Al is required for the deoxidation of molten steel but its upper limit is set at 1% to avoid a cost increase. Al increases the formation of non-metallic inclusions and deteriorates elongation when added excessively and, for this reason, a preferable content of Al is 0.5% or less.

Cu is added in an appropriate amount since, in solid solution, it improves the fatigue property. However, a tangible effect is not obtained with an addition amount of below 0.2%, but the effect saturates when contained in excess of 2%. Thus, the range of the Cu content has to be from 0.2 to 2%.

B is added in an appropriate amount since it raises fatigue limit when added in combination with Cu. An addition below 0.0002% is not enough to obtain the effect but, when added in excess of 0.002%, cracks are likely to occur in slabs. Hence, the B addition has to be 0.0002% or more and 0.002% or less.

An appropriate amount of Ni is added for preventing hot shortness caused by Cu. An addition below 0.1% is not enough to obtain the effect but, when added in excess of 1%, the effect saturates. For this reason its content has to be 0.1 to 1%.

Ca and REM change the shape of non-metallic inclusions, which initiate fractures and deteriorate workability, and render them harmless. But a tangible effect is not obtained when each of the addition amount is below 0.0005%. When Ca is added in excess of 0.002% or REM in excess of 0.02%, the effect saturates. Thus, it is preferable to add 0.0005 to 0.002% of Ca or 0.0005 to 0.02% of REM.

Additionally, precipitation hardening elements and/or solution hardening elements, namely one or more of Ti, Nb, Mo, V, Cr and zr, may be added to enhance strength. However, when the addition amount is below 0.05%, 0.01%, 0.05%, 0.02%, 0.01% and 0.02%, respectively, no tangible effect shows and, when added in excess of 0.5%, 0.5%, 1%, 0.2%, 1% and 0.2%, respectively, the effect saturates.

To obtain the effect of the present invention, no specific limit has to be set regarding Sn but, to avoid the occurrence of surface defects during hot rolling, it is preferable to limit its content to 0.05% or less.

Now, the reasons for defining the conditions of the production method according to the present invention will be described hereafter in detail.

In the present invention, slabs cast from molten steel prepared so as to contain the desired amounts of the component elements may be fed directly to a hot rolling mill while they are hot or fed to a hot rolling mill after being cooled to room temperature and then heating in a reheating furnace. No specific limit is set regarding the reheating temperature, but it is desirable that the reheating temperature is below 1,400° C. since, when it is 1,400° C. or higher, the amount of scale off becomes large and the product yield is reduced. It is also desirable that the reheating temperature is 1,000° C. or higher since a slab temperature below 1,000° C. remarkably lowers the operation efficiency of the mill in relation to its rolling schedule.

At finish rolling succeeding rough rolling in the hot rolling process, the rolling has to be completed at a final rolling temperature (FT) within the range from the $Ar_3$ transformation temperature to 100° C. above the $Ar_3$ transformation temperature. This is because, if the rolling temperature falls below the $Ar_3$ transformation temperature during hot rolling, strain remains in the steel sheet, its ductility is lowered, and thus workability is deteriorated, and, if the rolling completion temperature rises to more than 100° C. above the $Ar_3$ transformation temperature, the austenite grain size after the finish rolling becomes too large, causing insufficient progress of the ferrite transformation in the two-phase zone during the subsequent cooling process, and thus a desired microstructure is not obtained. For this reason, the finishing temperature has to be from the $Ar_3$ transformation temperature to 100° C. above the $Ar_3$ transformation temperature.

If high-pressure descaling is applied to a slab after rough rolling, it is preferable that the value of the impact pressure P (MPa) of high pressure water on the steel sheet surface multiplied by the flow rate L (l/cm$^2$) of the water is equal to or above 0.0025.

The impact pressure P of the high pressure water on a steel sheet surface is expressed as follows (see the Tetsu-to-Hagane, 1991, vol. 77, No. 9, pl450):

$$P(MPa)=5.64\times Po\times V\times H^2,$$

where Po (MPa) is the pressure of liquid, V (l/min.) is the liquid flow rate of a nozzle, and H (cm) is the distance between the nozzle and the steel sheet.

The flow rate L (l/cm$^2$) is expressed as follows:

$$L(l/cm^2)=V/(W\times v),$$

where V (l/min.) is the liquid flow rate of a nozzle, W (cm) is the width in which the liquid blown from a nozzle hits the steel sheet surface and v (cm/min.) is the travelling speed of the steel sheet.

To obtain the effect of the present invention, no specific upper limit has to be set regarding the value of the impact pressure P multiplied by the flow rate L, but it is preferable that the value is 0.02 or below since, when the liquid flow rate of a nozzle is increased, troubles such as increased wear of the nozzle and the like will occur.

It is preferable, further, that the maximum surface roughness Ry of the steel sheet after the finish rolling is 15 $\mu$m (15 $\mu$mRy, 12.5 mm, ln12.5 mm) or less. The reason for this is clear from the fact that the fatigue strength of a steel sheet as hot rolled or pickled correlates with the maximum roughness Ry of the steel sheet surface, as stated in page 84 of Metal Material Fatigue Design Handbook edited by the Society of Materials Science, Japan, for example. It is preferable that the finish hot rolling is done within 5 sec. after the high pressure descaling in order to prevent scale from forming again.

Immediately after the finish rolling, the steel sheet has to be held in the temperature range from the $Ar_3$ transformation temperature to the $Ar_1$ transformation temperature (the two-phase zone of ferrite and austenite) for 1 to 20 sec. This retention is meant for accelerating ferrite transformation in the two-phase zone. If the retention time is less than 1 sec., the ferrite transformation in the two-phase zone is not enough for obtaining a sufficient ductility and, if it exceeds 20 sec., on the other hand, pearlite forms and the desired compound structure having ferrite as the main phase and martensite, or retained austenite mainly as the second phase, is not obtained.

It is preferable that the temperature range during the retention for 1 to 20 sec. is from the $Ar_1$ transformation temperature to 800° C. for the purpose of promoting the ferrite transformation. To this end, it is preferable to cool the steel sheet to this temperature range as quickly as possible at a cooling rate of 20° C./sec. or higher after completing the finish rolling. Additionally, in order to avoid a drastic decease in productivity, it is preferable that the retention time is curtailed to 1 to 10 sec.

Then the steel sheet is cooled from the above temperature range to a coiling temperature (CT) at a cooling rate of 20° C./sec. or higher. If the cooling rate is below 20° C./sec., pearlite or bainite containing much carbide form and martensite or retained austenite does not form in a sufficient amount and, consequently, the desired microstructure having ferrite as the main phase and martensite or retained austenite as the second phase is not obtained.

The effect of the present invention can be enjoyed without bothering to specify an upper limit of the cooling rate during the cooling down to the coiling temperature but, to avoid the warping of a sheet caused by thermal strain, it is preferable to control the cooling rate to 200° C./sec. or below.

The coiling temperature has to be 350° C. or below when producing a steel sheet whose microstructure is a compound structure having ferrite as the main phase and martensite as the second phase. The reason for this is that, if the coiling temperature is above 350° C., bainite forms and martensite does not form in a sufficient amount, and thus the desired microstructure having ferrite as the main phase and martensite as the second phase is not obtained. Therefore, the coiling temperature has to be 350° C. or below. It is not necessary to specifically set a lower limit of the coiling temperature but, to avoid a bad appearance caused by rust when a coil is kept wet for a long period, it is preferable that the coiling temperature is 50° C. or above.

When producing a steel sheet whose microstructure is a compound structure having ferrite as the main phase and the retained austenite with a volume percentage of 5% or more and 25% or less as the second phase, the coiling temperature has to be above 350° C. and 450° C. or below. The reason for this is that, if the coiling temperature exceeds 450° C., bainite containing much carbide forms and retained austenite does not form in a sufficient amount, and thus the desired microstructure is not obtained, and that, if the coiling temperature is 350° C. or below, a large amount of martensite forms and retained austenite does not form in a sufficient amount, and thus the desired microstructure is not obtained. The coiling temperature, therefore, has to be above 350° C. and 450° C. or below.

In the present invention, a high fatigue strength steel sheet may also be a cold rolled steel sheet. In this case, although it is not necessary to strictly specify the conditions of cold rolling after pickling, it is preferable that the cold reduction rate is 30 to 80%. The reason for this is that, if the reduction rate is below 30%, recrystallization at the succeeding annealing process becomes incomplete and ductility is deteriorated, and that, if it is above 80%, the rolling load on a cold rolling mill becomes too high.

Finally, the present invention assumes that continuous annealing is employed in the annealing process. A steel sheet has to be heated to the two-phase temperature range, namely from the $Ac_1$ temperature to the $Ac_3$ temperature. However, it has to be noted that, if the heating temperature is too low even within the above temperature range and if cementite has precipitated after hot rolling, it takes too long for the cementite to return to solid solution, and that, if the heating temperature is too high even within the above temperature range, the volume percentage of austenite becomes too large, the carbon concentration in the austenite decreases and the cooling curve in the CCT diagram tends to cross the transformation nose of bainite containing much carbide or that of pearlite. For this reason, it is preferable that the heating temperature is 780° C. or above and 850° C. or below. with regard to the retention time, a retention time below 15 sec. is insufficient for the cementite to return to solid solution completely and, if the retention time exceeds 600 sec., it requires an undesirably slow travelling speed of the steel sheet. For the above reasons, the retention time has to be 15 to 600 sec. Then, for the cooling rate after the retention, when cooled at a rate below 20° C./sec., the cooling curve in the CCT diagram tends to cross the transformation nose of bainite containing much carbide or that of pearlite and, therefore, the cooling rate has to be 20° C./sec. or higher. If the cooling end temperature is higher than 350° C., the desired microstructure is not obtained, and hence the steel sheet has to be cooled to a temperature range of 350° C. or lower.

Further, when producing a high fatigue strength cold rolled steel sheet having retained austenite as the second phase, the steel sheet has to be held at a temperature of 350 to 450° C., namely a temperature range to accelerate bainite transformation and stabilize the retained austenite phase in a sufficient amount. If the holding temperature is above 450° C., the retained austenite dissolves into pearlite. If it is below 350° C., fine carbide precipitates and the retained austenite does not form in a desired amount, causing deterioration of ductility. For the above reasons, the holding temperature to accelerate the bainite transformation and stabilize the retained austenite in a sufficient amount is defined to be above 350° C. and 450° C. or lower. With regard to the retention time, if a retention time is below 15 sec., the acceleration of the bainite transformation is insufficient and unstable retained austenite transforms into martensite at the end of the cooling, and thus stable retained austenite phase is not obtained in a sufficient amount. If the retention time exceeds 600 sec., the bainite transformation is accelerated too much and the stable retained austenite phase is not obtained in a sufficient amount. Another problem with this is an undesirably slow travelling speed of the steel sheet. The retention time to accelerate the bainite transformation and stabilize the retained austenite phase in a sufficient amount is, therefore, 15 sec. or longer and 600 sec. or shorter. Finally, as for the cooling rate to the cooling end temperature, if it is below 5° C./sec., the bainite transformation is accelerated too much and the stable retained austenite phase may not be obtained in a sufficient amount. For this reason, the cooling rate has to be 5° C./sec. or more.

EXAMPLE 1

The present invention will be further explained based on examples.

Steels A to Q having the respective chemical compositions listed in Table 1 were produced using a converter, and each of them underwent the following production processes: continuous casting into slabs; reheating to the respective heating temperature (SRT) listed in Table 2, rough rolling and then finish rolling into a thickness of 1.2 to 5.4 mm at the respective final rolling temperature (FT) listed also in Table 2, and then coiling at the respective coiling temperature (CT) also listed in Table 2. Some of them underwent high pressure descaling under the condition of an impact pressure of 2.7 MPa and a flow rate of 0.001 $l/cm^2$ after the rough rolling.

The No. 5 test pieces according to JIS Z 2201 were cut out from the hot-rolled steel sheets thus produced and underwent a tensile test in accordance with the test method specified in JIS Z 2241. The test result is shown in Table 2. Here, the volume percentages of ferrite and the second phase are defined as their respective area percentages in the microstructure observed with a light-optic microscope at a magnification of 200 to 500 times at ¼ of the steel sheet thickness in a section surface along the rolling direction. Note that the average grain size of the ferrite was measured in accordance with the section method stipulated in the test method of ferrite crystal grain size of steel under JIS G 0552, and that the average grain size of the second phase was defined as the equivalent diameter of an average circle and the value obtained from an image processor and the like was used. Hardness was measured in accordance with the Vickers hardness test method specified in JIS Z 2244 under a testing force of 0.049 to 0.098 N and a retention time of 15 sec.

The carbon concentration in the second phase is the value obtained by the calibration curve method described in the literature (Hiroyoshi Soejima: Electron Beam Micro Analysis, published from Nikkan Kogyo Shimbunsha) using an EPMA (electron probe micro analyzer). Note that, because five or more of the second phase grains were measured, the carbon concentration value is an average value of the measured grains.

Regarding some of the specimens A to Q, the carbon concentration in the second phase was measured by the simplified measuring method.

Figure 4:
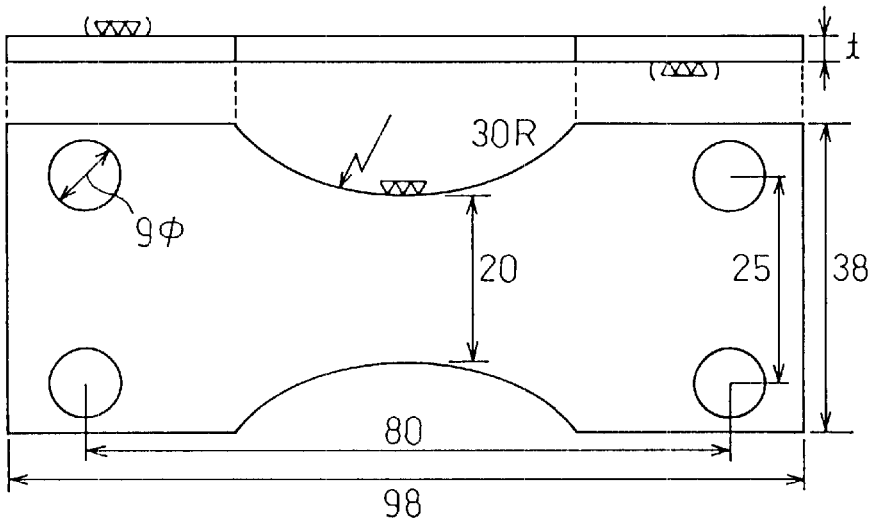
FIG. 4 is a view showing the shape of a test piece for a fatigue test.

Further, a fatigue test under completely reversed plane bending was conducted on the test pieces for plane bending fatigue test shown in FIG. 4 having a length of 98 mm, a width of 38 mm, a width of the minimum section portion of 20 mm and a notch radius of 30 mm. The fatigue property of the steel sheets was evaluated in terms of the quotient of the fatigue limit σW after $10\times10^7$ times of bending divided by the tensile strength σB of the steel sheet (the above quotient being a relative fatigue limit, expressed as σW/σB).

Note that no machining was done to the surfaces of the test pieces for the fatigue test and they were tested their surfaces left as pickled.

The burring workability (hole expansibility) was evaluated following the hole expanding test method according to the Standard of the Japan Iron and Steel Federation JFS T 1001-1996.

11 steels, namely steels A, B, C-6, G, K, L, M, N, O, P and Q, conform to the present invention. In each of them, what was obtained was the compound structure steel sheet excellent in burring workability having: prescribed amounts of component elements; a microstructure of a compound structure having ferrite as the phase accounting for the largest volume percentage and martensite mainly as the second phase; an average grain size of the ferrite being 2 μm or more and 20 μm or less; a quotient of the average grain size of the second phase divided by the average grain size of the ferrite being 0.05 or more and 0.8 or less; a carbon concentration in the second phase being 0.2% or more and 2% or less; a quotient of the volume percentage of the second phase Vs divided by the average grain size of the second phase dm being 3 or more and 12 or less; and a quotient of the average hardness of the second phase Hvs divided by the average hardness of the ferrite Hvf being 1.5 or more and 7 or less.

All the other steels fell outside the scope of the present invention for the following reasons:

In steel C-1, the final finish rolling temperature (FT) was above the range of the present invention and the grain size of the ferrite (Df), the size of the second phase (dm/Df), the carbon concentration in the second phase (Cm) and the grain size of the second phase (Vs/dm) were outside the respective ranges of the present invention, and, as a result, a sufficiently good value was not obtained in either the hole expansion rate (γ) or the relative fatigue limit (σW/σB).

In steel C-2, the final finish rolling temperature (FT) was below the range of the present invention, and the size of the second phase (dm/Df) and the difference in strength between the ferrite and the second phase (Hvs/Hvf) were outside the respective ranges of the present invention and, consequently, a sufficiently good value was not obtained in either the hole expansion rate (γ) or the relative fatigue limit (σW/σB). Besides, elongation (El) was low owing to residual strain.

In steel C-3, the cooling rate (CR) after the retention time was slower than the range of the present invention and the coiling temperature (CT) was higher than the range of the present invention and, as a consequence, the grain size of the ferrite (Df), the size of the second phase (dm/Df), the carbon concentration in the second phase (Cm) and the grain size of the second phase (Vs/dm) were outside the respective ranges of the present invention. As a result, a sufficiently good value was not obtained in either the hole expansion rate (λ) or the relative fatigue limit (σW/σB).

In steel C-4, the retention temperature (MT) after the finish rolling and before the coiling was below the range of the present invention, and the size of the second phase (dm/Df), the carbon concentration in the second phase (Cm) and the strength difference between the ferrite and the second phase (Hvs/Hvf) were outside the respective ranges of the present invention and, as a result, a sufficiently good value was not obtained in either the hole expansion rate (λ) or the relative fatigue limit (σW/σB).

In steel C-5, no retention time (Time) was secured between the finish rolling and the coiling, and the size of the second phase (dm/Df), the carbon concentration in the second phase (Cm) and the strength difference between the ferrite and the second phase (Hvs/Hvf) were outside the respective ranges of the present invention and, consequently, a sufficiently good value was not obtained in either the hole expansion rate (λ) or the relative fatigue limit (σW/σB).

In steel D, the desired microstructure was not obtained because the C content was outside the range of the present invention and, as a result, a sufficiently good value was not obtained in either the strength (TS) or the relative fatigue limit (σW/σB).

In steel E, the content of Si was outside the range of the present invention and, consequently, a sufficiently good value was not obtained in either the strength (TS) or the relative fatigue limit (σW/σB).

In steel F, the content of Mn was outside the range of the present invention, and the grain size of the ferrite (Df), the size of the second phase (dm/Df) and the grain size of the second phase (Vs/dm) were outside the respective ranges of the present invention and, as a result, a sufficiently good value was not obtained in any of the strength (TS), the hole expansion rate (λ) and the relative fatigue limit (σW/σB).

In steel H, the content of S was outside the range of the present invention and, as a result, a sufficiently good value was not obtained in either the hole expansion rate (λ) or the relative fatigue limit (σW/σB).

In steel I, the content of P was outside the range of the present invention and, consequently, a sufficiently good value was not obtained in the relative fatigue limit (σW/σB).

In steel J, the content of C was outside the range of the present invention and, as a result, a sufficiently good value was not obtained in any of the elongation(El), the hole expansion rate (λ) and the relative fatigue limit (σW/σB).

TABLE 1

| Steel | Chemical composition (in mass %) C | Si | Mn | P | S | Al | Others | Remark |
|---|---|---|---|---|---|---|---|---|
| A | 0.055 | 0.890 | 1.21 | 0.008 | 0.0006 | 0.032 | | Inventive example |
| B | 0.047 | 1.640 | 1.21 | 0.007 | 0.0008 | 0.025 | | Inventive example |
| C | 0.074 | 1.620 | 1.79 | 0.009 | 0.0009 | 0.026 | | Inventive example |
| D | 0.003 | 0.120 | 0.24 | 0.080 | 0.0008 | 0.019 | | Comparative example |
| E | 0.045 | 0.006 | 1.22 | 0.011 | 0.0011 | 0.030 | | Comparative example |
| F | 0.055 | 0.780 | 0.03 | 0.012 | 0.0008 | 0.033 | | Comparative example |
| G | 0.067 | 1.590 | 1.48 | 0.009 | 0.0007 | 0.032 | Cu: 1.18, Ni: 0.62, B: 0.0002 | Inventive example |
| H | 0.070 | 1.660 | 1.81 | 0.008 | 0.0300 | 0.028 | | Comparative example |
| I | 0.071 | 1.610 | 1.81 | 0.180 | 0.0010 | 0.025 | | Comparative example |
| J | 0.250 | 0.880 | 1.11 | 0.080 | 0.0008 | 0.027 | | Comparative example |
| K | 0.072 | 1.610 | 1.82 | 0.009 | 0.0011 | 0.030 | Ca: 0.0008 | Inventive example |
| L | 0.120 | 0.910 | 1.51 | 0.008 | 0.0013 | 0.038 | Ti: 0.08 | Inventive example |
| M | 0.081 | 1.881 | 1.60 | 0.007 | 0.0010 | 0.036 | Nb: 0.03 | Inventive example |
| N | 0.068 | 1.630 | 0.21 | 0.008 | 0.0009 | 0.022 | Mo: 0.63 | Inventive example |
| O | 0.066 | 1.210 | 2.11 | 0.077 | 0.0009 | 0.023 | V: 0.07 | Inventive example |
| P | 0.051 | 0.263 | 1.33 | 0.009 | 0.0011 | 0.026 | Cr: 0.11 | Inventive example |
| Q | 0.038 | 0.880 | 1.31 | 0.010 | 0.0012 | 0.028 | Zr: 0.05, REM: 0.0006 | Inventive example |

TABLE 2

| | Production condition | | | | | | Microstructure | | | | | | | | |
|---|---|---|---|---|---|---|---|---|---|---|---|---|---|---|---|
| Steel | SRT (° C.) | FT (° C.) | MT (° C.) | Time (s) | CR (° C./s) | CT (° C.) | Ferrite (%) | Martensite (%) | Bainite (%) | Cm (%) | Df (μm) | dm/Df | Second phase* (%) | Vs/dm | Hvs/Hvf |
| A | 1200 | 860 | 680 | 5 | 90 | 50 | 93 | 7 | 0 | 0.76 | 15 | 0.08 | 7 (7) | 5.8 | 6.3 |
| B | 1150 | 870 | 650 | 5 | 90 | 50 | 88 | 12 | 0 | 0.36 | 12 | 0.15 | 12 (12) | 6.7 | 3.3 |
| C-1 | 1150 | 910 | 670 | 5 | 90 | 50 | 60 | 10 | 30 | 0.15 | 21 | 0.90 | 40 (10) | 2.1 | 1.9 |
| C-2 | 1150 | 740 | 600 | 5 | 90 | 50 | 70 | 10 | 20 | 0.22 | 10 | 0.90 | 30 (10) | 3.3 | 1.4 |
| C-3 | 1150 | 820 | 600 | 5 | 5 | 550 | 40 | 0 | 60 | 0.12 | 26 | 1.50 | 60 (0) | 1.5 | 1.7 |
| C-4 | 1150 | 830 | 400 | 5 | 90 | 50 | 45 | 0 | 55 | 0.09 | 7 | 1.20 | 55 (0) | 6.5 | 1.2 |
| C-5 | 1150 | 810 | — | 0 | 90 | 50 | 50 | 0 | 50 | 0.12 | 6 | 1.00 | 50 (0) | 8.3 | 1.2 |
| C-6 | 1150 | 820 | 620 | 5 | 90 | 50 | 85 | 15 | 0 | 0.46 | 9 | 0.25 | 15 (15) | 6.7 | 3.4 |
| D | 1200 | 900 | 720 | 5 | 90 | 50 | 100 | 0 | 0 | — | 60 | — | 0 (0) | — | — |
| E | 1200 | 860 | 650 | 5 | 90 | 50 | 90 | 3 | 7 | 0.42 | 18 | 0.10 | 10 (3) | 5.6 | 5.3 |
| F | 1200 | 860 | 640 | 5 | 90 | 50 | 83 | 0 | 17 | 0.20 | 28 | 0.04 | 17 (0) | 16.3 | 5.5 |

TABLE 2-continued

| | | | | | | | | | | | | | | | |
|---|---|---|---|---|---|---|---|---|---|---|---|---|---|---|---|
| G | 1150 | 810 | 610 | 5 | 90 | 50 | 85 | 12 | 3 | 0.42 | 6 | 0.30 | 15 (12) | 8.3 | 3.4 |
| H | 1150 | 810 | 620 | 8 | 60 | 50 | 85 | 13 | 2 | 0.44 | 8 | 0.20 | 15 (13) | 9.4 | 3.2 |
| I | 1150 | 810 | 630 | 8 | 60 | 50 | 84 | 16 | 0 | 0.41 | 7 | 0.20 | 16 (16) | 11.4 | 3.1 |
| J | 1200 | 800 | 700 | 8 | 60 | 50 | 85 | 25 | 20 | 0.68 | — | — | 45 (25) | — | — |
| K | 1150 | 810 | 610 | 8 | 60 | 50 | 85 | 13 | 2 | 0.45 | 8 | 0.20 | 15 (13) | 9.4 | 3.3 |
| L | 1250 | 810 | 680 | 8 | 60 | 50 | 75 | 20 | 5 | 0.45 | 11 | 0.35 | 25 (10) | 8.5 | 4.0 |
| M | 1150 | 810 | 680 | 8 | 60 | 50 | 82 | 16 | 2 | 0.42 | 9 | 0.25 | 18 (16) | 8.0 | 3.1 |
| N | 1150 | 810 | 610 | 8 | 60 | 50 | 90 | 10 | 0 | 0.65 | 16 | 0.20 | 10 (10) | 3.1 | 6.5 |
| O | 1150 | 810 | 680 | 8 | 60 | 50 | 82 | 15 | 3 | 0.34 | 10 | 0.25 | 18 (15) | 7.2 | 2.8 |
| P | 1200 | 820 | 670 | 8 | 60 | 50 | 94 | 6 | 0 | 0.82 | 17 | 0.07 | 6 (8) | 5.0 | 6.1 |
| Q | 1200 | 840 | 670 | 8 | 60 | 50 | 94 | 6 | 0 | 0.60 | 15 | 0.07 | 6 (6) | 5.7 | 5.2 |

| | Mechanical properties | | | | | Fatigue property | | |
|---|---|---|---|---|---|---|---|---|
| Steel | σY (MPa) | σB (MPa) | YR (%) | El (%) | λ (%) | σW (MPa) | σW/σB (%) | Remark |
| A | 388 | 607 | 64 | 34 | 86 | 320 | 53 | Inventive example |
| B | 426 | 699 | 61 | 32 | 79 | 365 | 52 | Inventive example |
| C-1 | 653 | 845 | 77 | 19 | 29 | 380 | 45 | Comparative example |
| C-2 | 675 | 820 | 82 | 15 | 34 | 360 | 44 | Comparative example |
| C-3 | 562 | 733 | 77 | 28 | 33 | 330 | 45 | Comparative example |
| C-4 | 688 | 875 | 79 | 19 | 30 | 400 | 46 | Comparative example |
| C-5 | 551 | 810 | 68 | 20 | 39 | 350 | 43 | Comparative example |
| C-6 | 485 | 783 | 62 | 28 | 75 | 410 | 52 | Inventive example |
| D | 194 | 324 | 60 | 45 | 116 | 150 | 46 | Comparative example |
| E | 367 | 496 | 74 | 35 | 56 | 200 | 40 | Comparative example |
| F | 323 | 521 | 62 | 35 | 34 | 245 | 47 | Comparative example |
| G | 505 | 789 | 64 | 27 | 62 | 450 | 57 | Inventive example |
| H | 498 | 790 | 63 | 21 | 19 | 370 | 47 | Comparative example |
| I | 518 | 836 | 62 | 22 | 49 | 355 | 42 | Comparative example |
| J | 742 | 1160 | 64 | 11 | 5 | 450 | 39 | Comparative example |
| K | 479 | 786 | 61 | 27 | 61 | 410 | 52 | Inventive example |
| L | 469 | 722 | 65 | 26 | 70 | 370 | 51 | Inventive example |
| M | 528 | 812 | 65 | 23 | 64 | 420 | 52 | Inventive example |
| N | 345 | 556 | 62 | 34 | 90 | 280 | 50 | Inventive example |
| O | 525 | 821 | 64 | 22 | 65 | 430 | 52 | Inventive example |
| P | 337 | 561 | 60 | 35 | 92 | 290 | 52 | Inventive example |
| Q | 387 | 624 | 62 | 32 | 83 | 320 | 51 | Inventive example |

*Inclusive of retained austenite.
Figures between ( ) are martensite percentage.

EXAMPLE 2

The present invention will further be explained hereafter based on other examples.

Steels A to O having the respective chemical compositions listed in Table 3 were produced using a converter, and each of them underwent the following production processes: continuous casting into slabs; reheating to the respective heating temperature (SRT) listed in Table 4, rough rolling and then finish rolling into a thickness of 1.2 to 5.4 mm at the respective final rolling temperature (FT) listed also in Table 4, and then coiling at the respective coiling temperature (CT) also listed in Table 4. Some of them underwent a high pressure descaling under the condition of an impact pressure of 2.7 MPa and a flow rate of 0.001 l/cm$^2$ after the rough rolling.

TABLE 3

| No | Steel | Chemical composition (in mass %) C | Si | Mn | P | S | Al | Others | Remark |
|---|---|---|---|---|---|---|---|---|---|
| 1 | A | 0.100 | 1.360 | 1.32 | 0.008 | 0.0006 | 0.032 | | Inventive example |
| 2 | B | 0.003 | 0.120 | 0.24 | 0.080 | 0.0008 | 0.019 | | Comparative example |
| 3 | C | 0.090 | 0.007 | 1.35 | 0.010 | 0.0007 | 0.030 | | Comparative example |
| 4 | D | 0.120 | 1.400 | 0.02 | 0.007 | 0.0008 | 0.031 | | Comparative example |
| 5 | E | 0.150 | 1.920 | 1.46 | 0.010 | 0.0010 | 0.036 | CU: 0.58, Ni: 0.23, B: 0.0002 | Inventive example |
| 6 | F | 0.168 | 1.950 | 1.60 | 0.150 | 0.0010 | 0.041 | | Comparative example |
| 7 | G | 0.170 | 1.900 | 1.55 | 0.008 | 0.0300 | 0.035 | | Comparative example |
| 8 | H | 0.310 | 1.350 | 1.30 | 0.012 | 0.0011 | 0.041 | | Comparative example |
| 9 | I | 0.116 | 1.880 | 1.66 | 0.011 | 0.0006 | 0.032 | Ca: 0.0009 | Inventive example |
| 10 | J | 0.155 | 1.910 | 1.60 | 0.010 | 0.0007 | 0.030 | Ti: 0.07 | Inventive example |
| 11 | K | 0.171 | 1.790 | 1.75 | 0.008 | 0.0008 | 0.040 | Nb: 0.03 | Inventive example |
| 12 | L | 0.168 | 1.900 | 1.55 | 0.007 | 0.0007 | 0.041 | Mn: 0.61 | Inventive example |
| 13 | M | 0.095 | 1.400 | 1.35 | 0.013 | 0.0007 | 0.044 | V: 0.07 | Inventive example |
| 14 | N | 0.110 | 1.350 | 1.40 | 0.007 | 0.0009 | 0.021 | Cr: 0.12 | Inventive example |
| 15 | O | 0.100 | 1.330 | 1.44 | 0.011 | 0.0012 | 0.026 | Zr: 0.05, REM: 0.0004 | Inventive example |

Note:
Underlined figures are outside the present invention range.

The No. 5 test pieces according to JIS Z 2201 were cut out from the hot-rolled steel sheets thus produced and underwent a tensile test in accordance with the test method specified in JIS Z 2241. The test result is shown in Table 4. "Others" in "Micro structure" of Table 4 indicates pearlite or martensite. Here, the volume percentages of the retained austenite, ferrite, bainite, pearlite and martensite are defined as the respective area percentages observed with a light-optic microscope at a magnification of 200 to 500 times in the microstructure on the section surface at ¼ of the sheet thickness of the specimens cut out from the ¼ or ¾ width position of the steel sheets, after polishing the section surface along the rolling direction and etching it with a nitral reagent and a reagent disclosed in Japanese Unexamined Patent Publication No. H5-163590. However, some of the figures are those obtained by the X-ray diffraction method. The average grain size of the retained austenite was defined as the equivalent diameter of an average circle and the value obtained from an image processor and the like was used. Hardness was measured in accordance with the Vickers hardness test method specified in JIS Z 2244 under a testing force of 0.049 to 0.098 N and a retention time of 15 sec.

Further, a fatigue test under completely reversed plane bending was conducted on the test pieces for plane bending fatigue test shown in FIG. 4 having a length of 98 mm, a width of 38 mm, a width of the minimum section portion of 20 mm and a notch radius of 30 mm. The fatigue property of the steel sheets was evaluated in terms of the quotient of the fatigue limit $\sigma_W$ after $10\times10^7$ times of bending divided by the tensile strength $\sigma_B$ of the steel sheet (the above quotient being a relative fatigue limit, expressed as $\sigma_W/\sigma_B$). Note that no machining was done to the surfaces of the test pieces for the fatigue test and they were tested with their surfaces left as pickled.

The burring workability (hole expansibility) was evaluated in terms of the hole expansion value obtained by the hole expanding test method according to the Standard of the Japan Iron and Steel Federation JFS T 1001-1996.

TABLE 4

| No | Steel | Production condition SRT (° C.) | FT (° C.) | MT (° C.) | Time (s) | CR (° C./s) | CT (° C.) | Microstructure Ferrite (%) | Bainite (%) | Retained austenite (%) | Others (%) | Vs/dm | Hvs/Hvf |
|---|---|---|---|---|---|---|---|---|---|---|---|---|---|
| 1 | A-1 | 1200 | 850 | 660 | 8 | 90 | 380 | 85 | 5 | 10 | 0 | 3.3 | 3.1 |
| 2 | A-2 | 1200 | 740 | 660 | 8 | 90 | 380 | 85 | 10 | 5 | 0 | 2.4 | 2.8 |

TABLE 4-continued

| | | | | | | | | | | | | | |
|---|---|---|---|---|---|---|---|---|---|---|---|---|---|
| 3 | A-3 | 1200 | 920 | 660 | 8 | 90 | 380 | 65 | 35 | 0 | 0 | — | — |
| 4 | A-4 | 1200 | 850 | 540 | 8 | 90 | 380 | 35 | 65 | 0 | 0 | — | — |
| 5 | A-5 | 1200 | 850 | 720 | 8 | 90 | 380 | 60 | 30 | 0 | 10 | — | — |
| 6 | A-6 | 1200 | 850 | — | 0 | 90 | 380 | 60 | 40 | 0 | 0 | — | — |
| 7 | A-7 | 1200 | 850 | 660 | 8 | 5 | 380 | 80 | 10 | 0 | 10 | — | |
| 8 | A-8 | 1200 | 850 | 660 | 8 | 90 | 550 | 80 | 20 | 0 | 0 | — | — |
| 9 | A-9 | 1200 | 850 | 660 | 8 | 90 | 150 | 85 | 5 | 3 | 7 | 1.5 | 2.0 |
| 10 | B | 1200 | 900 | 720 | 5 | 90 | 400 | 100 | 0 | 0 | 0 | | — |
| 11 | C | 1150 | 810 | 620 | 8 | 90 | 400 | 40 | 60 | 0 | 0 | — | — |
| 12 | D | 1150 | 830 | 650 | 8 | 90 | 400 | 80 | 17 | 3 | 0 | 1.5 | 7.6 |
| 13 | E | 1150 | 820 | 630 | 8 | 90 | 410 | 70 | 15 | 15 | 0 | 3.8 | 2.2 |
| 14 | F | 1150 | 820 | 630 | 8 | 90 | 410 | 72 | 18 | 10 | 0 | 5.1 | 2.6 |
| 15 | G | 1150 | 820 | 630 | 8 | 90 | 410 | 66 | 18 | 16 | 0 | 4.9 | 2.3 |
| 16 | H | 1150 | 800 | 620 | 8 | 90 | 410 | 35 | 45 | 20 | 0 | 6.5 | 3.2 |
| 17 | I | 1150 | 820 | 630 | 8 | 90 | 410 | 68 | 16 | 16 | 0 | 8.6 | 2.0 |
| 18 | J | 1150 | 820 | 630 | 8 | 90 | 410 | 71 | 14 | 15 | 0 | 7.9 | 2.1 |
| 19 | K | 1150 | 820 | 630 | 8 | 90 | 410 | 70 | 15 | 15 | 0 | 7.8 | 2.3 |
| 20 | L | 1150 | 820 | 630 | 8 | 90 | 410 | 72 | 15 | 13 | 0 | 7.2 | 2.3 |
| 21 | M | 1200 | 850 | 650 | 5 | 55 | 390 | 85 | 7 | 8 | 0 | 3.1 | 1.8 |
| 22 | N | 1200 | 850 | 650 | 5 | 55 | 390 | 83 | 6 | 11 | 0 | 3.8 | 1.9 |
| 23 | O | 1200 | 850 | 650 | 5 | 55 | 390 | 83 | 7 | 10 | 0 | 3.7 | 1.8 |

| | Mechanical properties | | | | | Fatigue property | | |
|---|---|---|---|---|---|---|---|---|
| No | σY (MPa) | σB (MPa) | El (%) | TS × El (MPa · %) | λ (%) | σW (MPa) | σW/σB (%) | Remark |
| 1 | 439 | 617 | 37 | 22829 | 82 | 325 | 53 | Inventive example |
| 2 | 555 | 631 | 25 | 15775 | 42 | 320 | 51 | Comparative example |
| 3 | 491 | 622 | 25 | 15550 | 70 | 300 | 48 | Comparative example |
| 4 | 620 | 703 | 21 | 14763 | 85 | 300 | 43 | Comparative example |
| 5 | 480 | 620 | 21 | 13020 | 36 | 280 | 45 | Comparative example |
| 6 | 505 | 644 | 23 | 14812 | 76 | 300 | 74 | Comparative example |
| 7 | 472 | 588 | 24 | 14112 | 48 | 280 | 48 | Comparative example |
| 8 | 477 | 596 | 26 | 15496 | 90 | 290 | 49 | Comparative example |
| 9 | 435 | 650 | 30 | 19500 | 78 | 330 | 51 | Comparative example |
| 10 | 194 | 334 | 43 | 14362 | 121 | 150 | 45 | Comparative example |
| 11 | 408 | 526 | 29 | 15254 | 42 | 245 | 47 | Comparative example |
| 12 | 421 | 544 | 27 | 14688 | 38 | 250 | 46 | Comparative example |
| 13 | 583 | 789 | 30 | 23670 | 61 | 440 | 56 | Inventive example |
| 14 | 592 | 822 | 28 | 23016 | 28 | 380 | 46 | Comparative example |
| 15 | 603 | 815 | 23 | 18745 | 22 | 370 | 45 | Comparative example |
| 16 | 854 | 1073 | 11 | 11803 | 16 | 450 | 42 | Comparative example |
| 17 | 548 | 769 | 31 | 23839 | 70 | 385 | 50 | Inventive example |
| 18 | 590 | 786 | 30 | 23580 | 66 | 390 | 50 | Inventive example |
| 19 | 620 | 826 | 28 | 23128 | 62 | 425 | 51 | Inventive example |
| 20 | 584 | 811 | 28 | 22708 | 60 | 420 | 52 | Inventive example |
| 21 | 449 | 607 | 36 | 21852 | 78 | 320 | 53 | Inventive example |
| 22 | 450 | 641 | 35 | 22435 | 75 | 340 | 53 | Inventive example |
| 23 | 447 | 621 | 34 | 21114 | 86 | 330 | 53 | Inventive example |

Note:
Underlined figures are outside the present invention range.

9 steels, namely steels A-1, E, I, J, K, L, M, N and O conform to the present invention. In each of them, what was obtained was a work-induced transformation type compound structure steel sheet excellent in burring workability characterized by having: prescribed amounts of component elements; a microstructure of a compound structure containing retained austenite accounting for a volume percentage of 5% or more and 25% or less and the balance consisting mainly of ferrite and bainite; a quotient of the volume percentage of the retained austenite divided by its average grain size being 3 or more and 12 or less; and a quotient of the average hardness of the retained austenite divided by the average hardness of the ferrite being 1.5 or more and 7 or less.

All the other steels fell outside the scope of the present invention for the following reasons.

In steel A-2, the final finish rolling temperature (FT) was below the range of the present invention and, as a result, both a strength-ductility balance (TS×El) and the hole expansion rate (λ) were low owing to residual strain. In steel A-3, the final finish rolling temperature (FT) was above the range of the present invention and thus the desired microstructure was not obtained and, as a result, both the strength-ductility balance (TS×El) and the relative fatigue limit ($\sigma_W/\sigma_B$) were low. In steel A-4, the retention temperature (MT) after finish rolling and before coiling was below the range of the present invention and thus the desired microstructure was not obtained and, consequently, both the strength-ductility balance (TS×El) and the relative fatigue limit ($\sigma_S/\sigma_B$) were low.

In steel A-5, the retention temperature (MT) after finish rolling and before coiling was above the range of the present invention and thus the desired microstructure was not obtained, and consequently, both the strength-ductility balance (TS×El) and the relative fatigue limit ($\sigma_W/\sigma_B$) were low. In steel A-6, no retention time (Time) was secured between finish rolling and coiling and thus the desired microstructure was not obtained and, as a result, both the strength-ductility balance (TS×El) and the relative fatigue limit ($\sigma_W/\sigma_B$) were low. A sufficient value of hole expansion rate (λ) was not obtained, either. In steel A-7 the cooling rate (CR) after the retention was slower than the range of the present invention and thus the desired microstructure was not obtained and, as a result, both the strength-ductility balance (TS×El) and the relative fatigue limit ($\sigma_W/\sigma_B$) were low. A sufficient value of hole expansion rate (λ) was not obtained, either. In steel A-8, the coiling temperature (CT) was above the range of the present invention and thus the desired microstructure was not obtained and, consequently, the strength-ductility balance (TS×El) was low. In steel A-9, the coiling temperature (CT) was below the range of the present invention and thus the desired microstructure was not obtained and, as a result, the strength-ductility balance (TS×El) was low.

In steel B, the desired microstructure was not obtained because the C content was outside the range of the present invention and, as a result, a sufficiently good value was not obtained in either the strength (TS) or the relative fatigue limit ($\sigma_W/\sigma_B$). In steel C, the content of Si was outside the range of the present invention and, as a result, a sufficiently good value was not obtained in either the strength (TS) or the relative fatigue limit ($\sigma_W/\sigma_B$). In steel D, the content of Mn was outside the range of the present invention and thus the desired microstructure was not obtained and, as a result, both the strength-ductility balance (TS×El) and the relative fatigue limit ($\sigma_W/\sigma_B$) were low. In steel F, the content of P was outside the range of the present invention and, as a result, a sufficiently good value was not obtained in the relative fatigue limit ($\sigma_W/\sigma_B$). In steel G, the content of S was outside the range of the present invention and, as a result, a sufficiently good value was not obtained in either the hole expansion rate (λ) or the relative fatigue limit ($\sigma_W/\sigma_B$). In steel H, the C content was outside the range of the present invention and, as a result, a sufficiently good value was not obtained in any of the elongation (El), the hole expansion rate (λ) and the relative fatigue limit

INDUSTRIAL APPLICABILITY

As heretofore described in detail, the present invention provides a compound structure steel sheet excellent in burring workability having a tensile strength of 540 MPa or more, and a method to produce the same. The hot-rolled steel sheet according to the present invention realizes a remarkable improvement in burring workability (hole expansibility) while maintaining a sufficiently good fatigue property and, therefore, the present invention has a high industrial value.

What is claimed is:

1. A high fatigue strength steel sheet excellent in burring workability characterized in that:

the steel sheet is made of a steel containing, by mass,
0.01 to 0.3% of C,
0.01 to 2% of Si,
0.05 to 3% of Mn,
0.1% or less of P,
0.01% or less of S, and
0.005 to 1% or Al, and the balance consisting of Fe and unavoidable impurities;

the microstructure is a compound structure having ferrite as the main phase and martensite as the second phase;

the quotient of the volume percentage of the second phase divided by its average grain size is 3 or more and 12 or less; and the quotient of the average hardness of the second phase divided by the average hardness of the ferrite is 1.5 or more and 7 or less.

2. A high fatigue strength steel sheet excellent in burring workability according to claim 1, characterized in that; the steel further contains, in mass, 0.2 to 2% of Cu, and the Cu exists in the ferrite phase of the steel in the state of the precipitates of grains 2 nm or less in size consisting purely of Cu and/or in the state of solid solution.

3. A high fatigue strength steel sheet excellent in burring workability according to claim 1, characterized by further containing, by mass, 0.0002 to 0.002% of B.

4. A high fatigue strength steel sheet excellent in burring workability according to claim 1, characterized by further containing, by mass, 0.1 to 1% of Ni.

5. A high fatigue strength steel sheet excellent in burring workability according to claim 1, characterized by further containing, by mass, one or both of 0.0005 to 0.002% of Ca and 0.0005 to 0.02% of REM.

6. A high fatigue strength steel sheet excellent in burring workability according to claims, characterized by further containing, by mass, one or more of;

0.05 to 0.5% of Ti,
0.01 to 0.5% of Nb, 0.05 to 1% of Mo, 0.02 to 0.2% of V, 0.01 to 1% of Cr, and 0.02 to 0.2% of Zr.

7. A high fatigue strength steel sheet excellent in burring workability according to claim 1, characterized in that the microstructure is a compound structure having ferrite as the main phase and retained austenite accounting for a volume percentage of 5% or more and 25% or less as an additional phase.

8. A method to produce a high fatigue strength steel sheet excellent in burring workability according to claim 1, characterized by, when hot rolling a slab having said chemical composition, completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of 350° or lower.

9. A method to produce a high fatigue strength steel sheet excellent in burring workability according to claim 1, characterized by, when hot rolling a slab having said chemical composition, applying high pressure descaling to the slab after rough rolling, completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the $Ar_3$ transformation temperature for 1 to 20 sec., then cooling it at a cooling rate of 20° C./sec. or higher, and coiling it at a coiling temperature of 350° C. or lower.

10. A method to produce a high fatigue strength steel sheet excellent in burring workability according to claim 1, characterized by completing the hot rolling of a slab having said chemical composition at a temperature of the $Ar_3$ transformation temperature or higher, subsequently pickling and cold-rolling the hot-rolled steel sheet thus produced, holding the cold-rolled steel sheet in the temperature range from the $Ac_1$ transformation temperature to the $Ac_3$ transformation temperature for 30 to 150 sec., then cooling it at a cooling rate of 20° C./sec. or higher to the temperature range of 350° C. or lower.

11. A method to produce a high fatigue strength steel sheet excellent in burring workability according to claim 1, characterized by, when hot rolling a slab having said chemical composition, completing finish hot rolling at a temperature from the $Ar_3$ transformation temperature to 100° C. above the $Ar_3$ transformation temperature, holding the hot-rolled steel sheet thus produced in the temperature range from the $Ar_1$ transformation temperature to the Ar3 transformation temperature for 1 to 20 sec., then cooling it at a cooling rate of 20° C./sec. or higher, and coiling it at a coiling temperature of above 350° C. and 450° C. or lower.

12. A method to produce a high fatigue strength steel sheet excellent in burring workability according to claim 1, characterized by, when hot rolling a slab having said chemical composition, applying high pressure descaling to the slab after rough rolling, completing finish hot rolling at a temperature from the $Ar_3$ transformation temperature to 100° C. above the method to produce a high fatigue strength steel sheet excellent in burring workability according to claim 2, characterized by, holding the hot-rolled steel sheet thus produced in the temperature range from the $Ar_1$ transformation temperature to the $Ar_3$ transformation temperature for 1 to 20 sec., then cooling it at a cooling rate of 20°C./sec. or higher, and coiling it at a coiling temperature of above 350° C. and 450° C. or lower.

13. A method to produce a high fatigue strength steel sheet excellent in burring workability according to claim 1, characterized by, completing the hot rolling of a slab having said chemical composition at a temperature of the $Ar_3$ transformation temperature or higher, subsequently pickling and cold rolling the hot-rolled steel sheet thus produced, holding the cold-rolled steel sheet in the temperature range from the $Ac_1$ transformation temperature to the $Ac_3$ transformation temperature for 30 to 150 sec., then cooling it at a cooling rate of 20° C./sec. or higher, holding it in the temperature range of above 350° C. and 450° C. or lower for 15 to 600 sec., and cooling it at a cooling rate of 5° C./sec or higher to the temperature range of 150° C. or below.

14. A method to produce a high fatigue strength steel sheet excellent in burring workability comprising:

hot rolling a slab having a chemical composition comprising, by mass:
0.01 to 0.3% of C,
0.01 to 2% of Si,
0.05 to 3% of Mn,
0.1% or less of P,
0.01% or less of 5, and
0.005 to 1% of Al, and the balance consisting of Fe and unavoidable impurities;

completing finish hot rolling at a temperature from the $Ar_3$ transformation temperature to 100° C. above the $Ar_3$ transformation temperature to produce a hot-rolled steel sheet;

holding the hot-rolled steel sheet in a temperature range from the $Ar_1$ transformation temperature to the $Ar_3$ transformation temperature for 1 to 20 seconds;

then cooling the hot-rolled steel sheet at a cooling rate of 20° C./second or higher;

coiling the cooled hot-rolled steel sheet at a coiling temperature of 350° C. or lower;

thereby providing the steel sheet wherein:

the microstructure is a compound structure having ferrite as the main phase and martensite as the second phase;

the average grain size of the ferrite is 2 $\mu$n or more and 20 $\mu$m or less;

the quotient of the average grain size of the second phase divided by the average grain size of the ferrite is 0.05 or more and 0.8 or less; and the carbon concentration in the second phase is 0.2% or more and 3% or less.

15. A method to produce a high fatigue strength steel sheet excellent in burring workability comprising:

hot rolling a slab having a chemical composition comprising, by mass:
0.01 to 0.3% of C,
0.01 to 2% of Si,
0.05 to 3% of Mn,
0.1% or less of P, 0.01% or less of 5, and
0.005 to 1% of Al, and the balance consisting of Fe and unavoidable impurities;

completing finish hot rolling at a temperature from the $Ar_3$ transformation temperature to 100° C. above the $Ar_3$ transformation temperature to produce a hot-rolled steel sheet;

holding the hot-rolled steel sheet in a temperature range from the $Ar_1$ transformation temperature to the $Ar_3$ transformation temperature for 1 to 20 seconds;

then cooling the hot-rolled steel sheet at a cooling rate of 20° C./second or higher;

coiling the cooled hot-rolled steel sheet at a coiling temperature of above 350° C. and 450° C. or lower;

thereby providing the steel sheet wherein:

the microstructure is a compound structure having ferrite as the main phase and martensite as the second phase;

the average grain size of the ferrite is 2 $\mu$m or more and 20 $\mu$m or less;

the quotient of the average grain size of the second phase divided by the average grain size of the ferrite is 0.05 or more and 0.8 or less; and the carbon concentration in the second phase is 0.2% or more and 3% or less.

16. A method to produce a high fatigue strength steel sheet excellent in burring workability according to claim 14 or 15, further comprising:

apply high pressure descaling to the slab after rough rolling.

17. A method to produce a high fatigue strength steel sheet excellent in burring workability comprising:

hot rolling a slab having a chemical composition comprising, by mass:
0.01 to 0.3% of C,
0.01 to 2% of Si,
0.05 to 3% of Mn,
0.1% or less of P,
0.01% or less of 5, and
0.005 to 1% of Al, and the balance consisting of Fe and unavoidable impurities;

completing hot rolling of the slab at a temperature of the $Ar_3$ transformation temperature or higher to produce a hot-rolled steel sheet;

pickling the hot-rolled steel sheet;

cold rolling the hot-rolled steel sheet to produce a cold-rolled steel sheet;

holding the cold-rolled steel sheet in a temperature range from the $Ac_1$ transformation temperature to the $Ac_3$ transformation temperature for 30 to 150 seconds;

then cooling the cold-rolled steel sheet at a cooling rate of 20° C./second or higher to a temperature range of 350° C. or lower;

thereby providing the steel sheet wherein:

the microstructure is a compound structure having ferrite as the main phase and martensite as the second phase;

the average grain size of the ferrite is 2 $\mu$m or more and 20 $\mu$m or less;

the quotient of the average grain size of the second phase divided by the average grain size of the ferrite is 0.05 or more and 0.8 or less; and the carbon concentration in the second phase is 0.2% or more and 3% or less.

18. A method to produce a high fatigue strength steel sheet excellent in burring workability comprising:

hot rolling a slab having a chemical composition comprising, by mass:
0.01 to 0.3% of C,
0.01 to 2% of Si,
0.05 to 3% of Mn,
0.1% or less of P,
0.01% or less of 5, and
0.005 to 1% of Al, and the balance consisting of Fe and unavoidable impurities;

completing hot rolling of the slab at a temperature of the $Ar_3$ transformation temperature or higher to produce a hot-rolled steel sheet;

pickling the hot-rolled steel sheet;

cold rolling the hot-rolled steel sheet to produce a cold-rolled steel sheet;

holding the cold-rolled steel sheet in a temperature range from the $Ac_1$ transformation temperature to the $Ac_3$ transformation temperature for 30 to 150 seconds; then cooling the cold-rolled steel sheet at a cooling rate of 20° C./second or higher;

holding the cooled cold-rolled steel sheet in a temperature range of above 350° C. and 450° C. or lower for 15 to 600 seconds;

then further cooling the cooled cold-rolled steel sheet at a cooling rate of 5° C./second or higher to a temperature range of 150° C. or below;

thereby providing the steel sheet wherein:

the microstructure is a compound structure having ferrite as the main phase and martensite as the second phase;

the average grain size of the ferrite is 2 $\mu$m or more and 20 $\mu$m or less;

the quotient of the average grain size of the second phase divided by the average grain size of the ferrite is 0.05 or more and 0.8 or less; and the carbon concentration in the second phase is 0.2% or more and 3% or less.

19. A method to produce a high fatigue strength steel sheet excellent burring workability according to claim 14, 15, 17 or 18, wherein said chemical composition of said slab further comprises one or more of, by mass:

0.0002 to 0.002% of B,
0.1 to 1% of Ni,
0.0005 to 0.002% of Ca,
0.0005 to 0.02% of REM,
0.05 to 0.5% of Ti,
0.01 to 0.5% of Nb,
0.05 to 1% of Mo,
0.02 to 0.2% of V,
0.01 to 1% of Cr, and
0.02 to 0.2% of Zr.

20. A method to produce high fatigue strength steel sheet excellent in b workability according to claim 14, 15, 17, or 18, wherein the slab further contains, in mass, 0.2 to 2% of Cu, and the Cu in the steel sheet exists in the ferrite phase of the steel in the state of the precipitates of grains 2 nm or less in size consisting purely of Cu and/or in the state of solid solution.

21. A method to produce a high fatigue strength steel sheet excellent in bur-ring workability according to claim 14, 15, 17, or 18, characterized in that the microstructure of the steel sheet is a compound structure having ferrite as the main phase and retained austenite accounting for a volume percentage of 5% or more and 25% or less as an additional phase.

* * * * *